US005203852A

United States Patent [19]

Downing et al.

[11] Patent Number: 5,203,852

[45] Date of Patent: Apr. 20, 1993

[54] CARPET TUCKING DEVICE

[76] Inventors: Keith A. Downing, 1708 Regent Ave., Redding, Calif. 96001; Michael Downing, 2421 Celestial St., Redding, Calif. 96002

[21] Appl. No.: 822,105

[22] Filed: Jan. 17, 1992

[51] Int. Cl.[5] ..... A47G 27/04; B25B 27/02

[52] U.S. Cl. ..... 294/8.6; 7/103; 29/270; 81/488

[58] Field of Search ..... 294/8.6, 19.1; 7/103; 15/144 B, 230.11; 16/4, 5, 115; 29/235, 238, 243.5, 270, 278; 81/488; 254/200, 203

[56] References Cited

U.S. PATENT DOCUMENTS

| | | | |
|---|---|---|---|
| 393,909 | 12/1888 | Kingsland | 294/8.6 |
| 3,538,523 | 11/1970 | Sparks | 7/103 |
| 3,546,726 | 12/1970 | Bizzigotti | 7/103 |
| 3,617,082 | 11/1971 | Sparks | 294/8.6 |
| 3,673,621 | 7/1972 | Pecorella | 7/103 |
| 4,426,760 | 1/1984 | Watts | 29/235 X |
| 4,605,253 | 8/1986 | Anderson | 294/8.6 |
| 4,750,226 | 6/1988 | Costil! | 7/103 |
| 4,790,059 | 12/1988 | Killpack | 7/103 X |
| 4,797,963 | 1/1989 | Gulino | 7/103 |
| 4,949,604 | 8/1990 | Squires | 81/488 |

*Primary Examiner*—Johnny D. Cherry
*Attorney, Agent, or Firm*—Bielen, Peterson & Lampe

[57] ABSTRACT

A carpet tucking device utilizing a rotatable member having a core and a removable cover for the core. The cover possesses an outer surface capable of contacting the carpet and further includes a first flange portion and second endless portion. A handle is connected to the rotatable member by a connecting element which forms an obtuse angle between the handle and the rotatable member.

10 Claims, 2 Drawing Sheets

CARPET TUCKING DEVICE

BACKGROUND OF THE INVENTION

The present invention relates to a novel carpet tucking device useful in the laying of carpets on surfaces.

To install wall-to-wall carpeting, a tack strip is placed at the perimeter of the room adjacent the wall. The purpose of the tack strip is to secure the stretched carpet which will be laid atop the tack strip and to prevent movement subsequent to the installation of the carpet. A gap is left between the tack strip and the wall or adjacent structure of the room so that the edge of a newly layed and trimmed carpet may be tucked between the two and, thus, present a finished appearance.

Certain problems arise in the carrying out of the carpet laying process, namely the installer must exercise extreme caution not to damage the wall or adjacent uncarpeted surfaces, such as tile. In addition, it is extremely important not to mar or dirty the wall adjacent the edge of the carpet in the process of laying the carpet.

In the past, devices have been proposed for attaching a carpet to a tack strip such as that found in U.S. Pat. No. 3,617,082. U.S. Pat. No. 3,546,726 proposes a carpet tucker which utilizes a beveled wheel to roll the carpet into the gap between the tack strip and the baseboard or wall. U.S. Pat. No. 4,426,760 utilizes a pair of rotating wheels in a similar manner.

U.S. Pat. No. 4,797,963 proposes a carpet finishing tool which utilizes a rotatable disk which may be used to tuck a carpet between a tack strip and a wall as well as securing a carpet using adhesive rather than tack strips. The disk in the U.S. Pat. No. 4,797,963 patent is attached at an obtuse angle to the shaft used to exert the downward force.

U.S. Pat. No. 4,790,059 discloses a rotatable disk and blade combination tool to tuck the carpet in the gap between the tack strip and the wall. U.S. Pat. No. 4,750,226 employs a tucking wheel in combination with a spaced swivel block to press the carpet firmly against a tack strip or adhesive.

Although the prior art attempts to solve the problems enumerated above, a device which quickly and accurately tucks a carpet into the gap between the tack strip and the wall as well as pressing the carpet onto the tack strip in one operation without damaging adjacent structures is not shown in the prior art. A device which solves these problems would be great advance in the field of interior finishing.

SUMMARY OF THE INVENTION

In accordance with the present invention a novel and useful carpet tucking device is herein provided.

The carpet tucking device of the present invention utilizes a rotatable member which includes a core and a cover for the core. The cover forms an outer surface of the rotatable member and includes a first portion having a flange for tucking the carpet and a second portion for pressing the carpet onto the tack strip. The second portion of the cover may include a body having a end surface. The core may further include a bearing having inner and outer races such that the cover is removably fastened to the outer race of the bearing. In this regard, the cover may be formed of soft, flexible, and replaceable material which is less likely to damage structures adjacent the carpet.

A handle is also included in the present invention which may be formed in two parts which are separable. Thus the handle may be used by the carpet laying person in a standing or kneeling position. The latter is especially useful in tight spaces such as closets.

A connecting element links the rotatable member to the handle. The connecting element may include the first part which directly connects to the rotatable member through a tongue which may extend into the inner race of the bearing. A second part of the connecting element links to the first part of the connecting element at an obtuse angle and further connects to the handle. Thus, the handle orients at an obtuse angle to the rotatable member. The tongue may further form a boss which would enter the interior portion of the rotatable member cover where that body is a hollow member. Thus, the boss would provide a degree of support for the cover where such cover is flexible.

It may be apparent that a novel and useful carpet tucking device has been described.

It is therefore an object of the present invention to provide a carpet tucking device which is usable by a person in an upright position or in a kneeling position.

It is another object of the present invention to provide a carpet tucking device which greatly minimizes damage to structures adjacent the carpet such as walls and baseboards during the carpet laying process.

A further object of the present invention is to provide a carpet tucking device which simultaneously performs the function of forcing the edge of the carpet into the gap between a tack strip and the wall of the room as well as pressing the perimeter of a carpet against the tack strip.

A further object of the present invention is to provide a carpet tucking device which utilizes a cover on a rotatable member which performs the function of tucking the carpet into the gap between a tack strip and the wall of a room as well as pressing the perimeter of the carpet onto the tack strip.

Yet another object of the present invention is to provide a carpet tucking device which utilizes a soft and flexible cover for performing the tucking function which permits use of a tucking device adjacent other floor covering such as wood and tile.

The invention possess other objects and advantages especially as concerns particular characteristics and features thereof which will become apparent as the specification continues.

For a better understanding of the invention reference is made to the following detailed description of the preferred embodiment thereof which should be referenced to the herein before described drawings.

DESCRIPTION OF THE PREFERRED EMBODIMENTS

Various aspects of the present will evolve from the following detailed description of the preferred embodiments which should be referenced to the prior described drawings.

Figure 1:
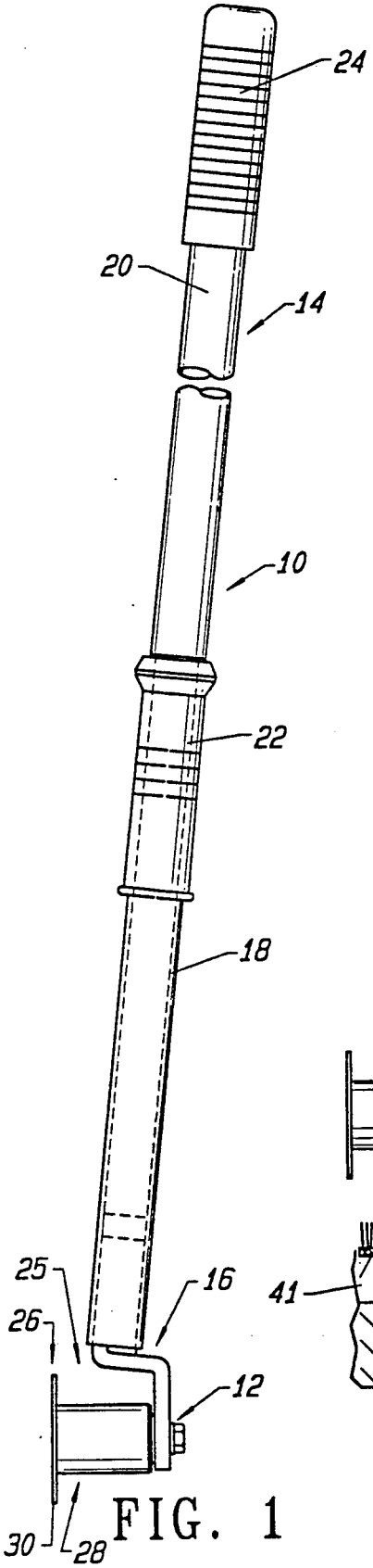
FIG. 1 is a front elevational view of the device of the present invention showing a portion of a handle in broken configuration.
Figure 2:
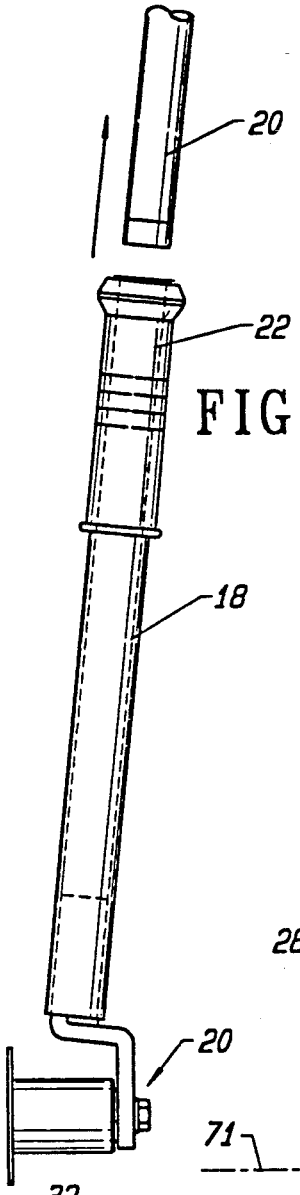
FIG. 2 is a partial front elevation of the device of the present invention depicting a portion of the handle in exploded configuration.

The invention as a whole is depicted in the drawings by reference character 10. The carpet tucking device 10, FIG. 1, possesses a rotatable member 12, a handle portion 14, and a connecting element 16. With reference to FIGS. 1 and 2, it may be observed that handle 14 includes a first portion 18 and a removable second portion 20. Gripping members 22 and 24 are attached to first and second portions 18 and 20 of handle 14, respectively. The user may easily grip handle 14 in either the long configuration, FIG. 1, or short configuration, FIG. 2. Handle 14 may be constructed of any rigid materials such as metal, wood, plastic, and the like.

Figure 3:
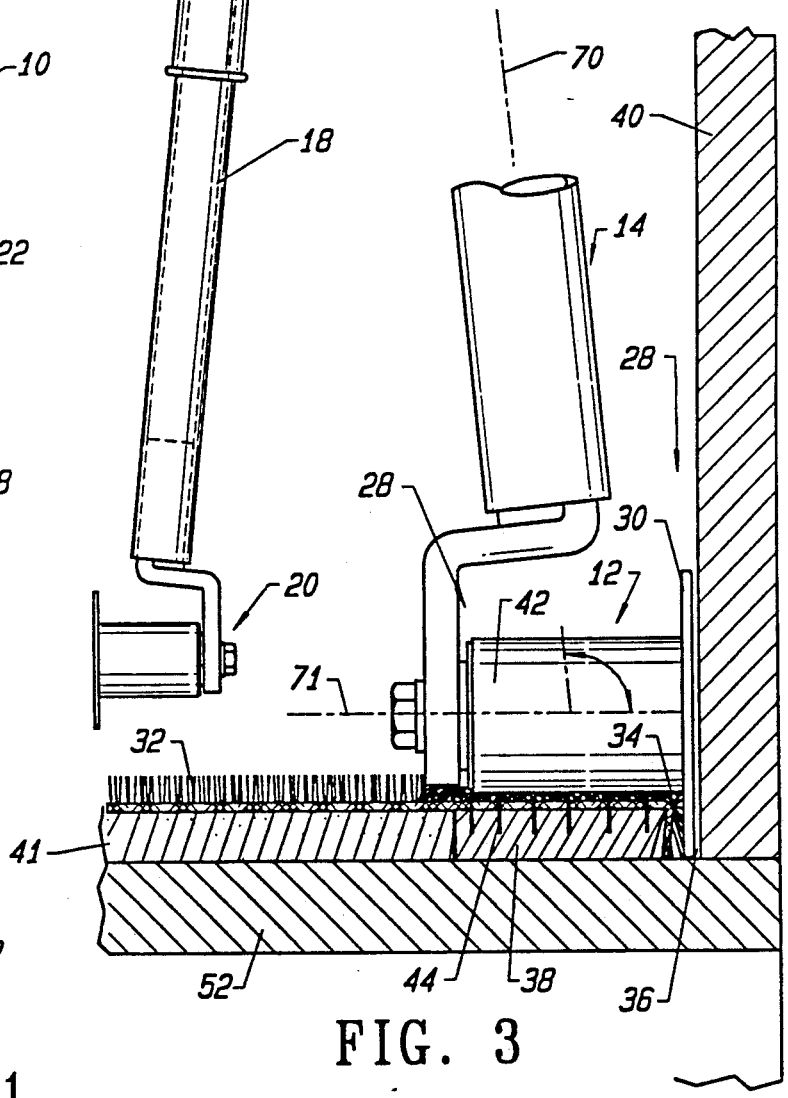
FIG. 3 is a partial front elevational view of the device of the present invention in use with a carpet lying against a wall shown in section.

Referring now to FIG. 3, it may be observed that rotatable member 12 includes a cover 25 having a first portion 26 and a second portion 28. First portion 26 of cover 25 is constructed with a flange 30 that is intended to contact the edge of carpet 32, FIG. 3, and to force the edge 34 of carpet 32 into the gap 36 between tack board 38 and wall 40. It should be noted that a foam pad 41 lies adjacent tack board 38, an arrangement representative of the normal carpet laying technique. Second portion 28 of cover 25 is provided with an endless outer surface which is also intended to contact carpet 32. Endless surface is depicted in FIG. 3 as a cylindrical surface that presses end portion 44 of carpet 32 onto tack board 38 for fastening thereto.

Figure 4:
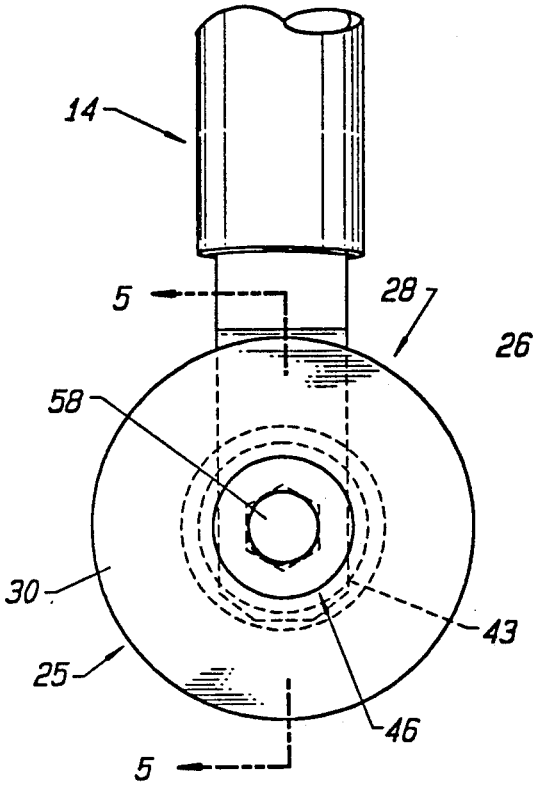
FIG. 4 is a partial side elevational view of the device of the present invention showing the rotatable member.
Figure 5:
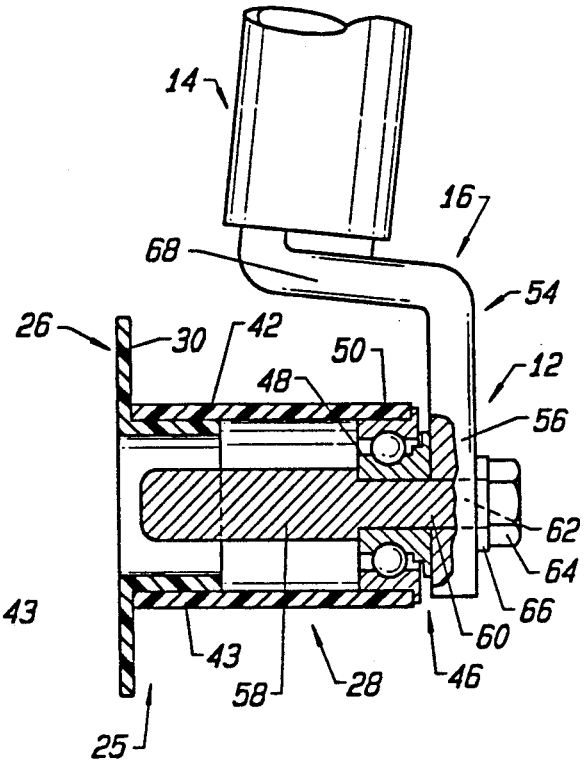
FIG. 5 is a sectional view taken along line 5—5 of FIG. 4.
Figure 6:
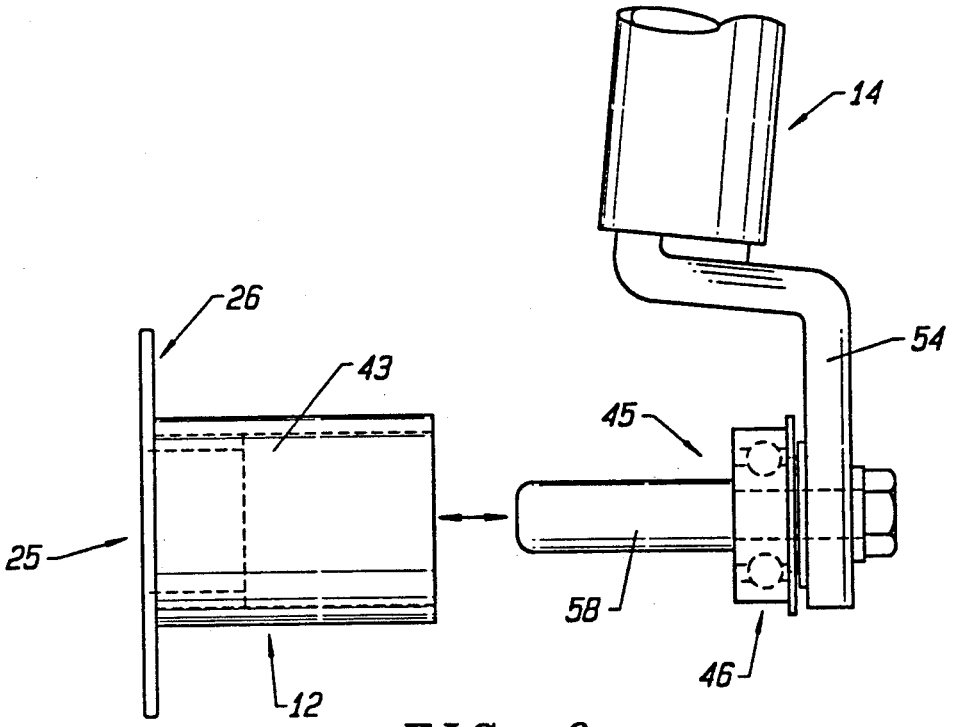
FIG. 6 is a partial front elevational view of the device of the present invention showing the rotatable member in exploded configuration.

With reference to FIGS. 4 and 5, it may be observed that rotatable member 28 also possesses a core 45 having a bearing 46 with an inner race 48 and an outer race 50. Cylindrical body 43 fits over the outer race 48 and is held thereto for rotation with the outer race through friction force. First portion 26 of cover 25 is depicted as a hollow body which fits within cylindrical body 43 and is held thereto by fastening means such as glue. It should be apparent that first portion 26 and cylindrical body 43 of cover 25 may be formed as a unitary element. As such, cover 25 is removably fastened to outer race 50 of bearing 46, FIG. 6. Bearing 46 may be a metallic member while cover 25 may be constructed of soft, flexible, plastic material which is subject to wear, yet undamaging to structures adjacent carpet 32 such as wall 40 and floor 52.

Connecting element 16 is also depicted in detail on FIGS. 4 and 5 and is shown as including a crooked member 54 which possesses a first part 56 linked to rotatable member 12 via pin or boss 58 of core 45. Pin 58 includes a narrow portion or tongue 60 which fixes to inner race 48 of bearing 46 and extends outwardly from rotatable member 12, terminating in a threaded end portion 62. Bolt 64 and washer 66 hold pin 58 to first part 56 of crooked member 54. Second part 68 of crook member 54 connects to first part 56 at an obtuse angle formed between axis 70 of handle 14 and axis 71 of rotatable member 12. This aspect of the present invention allows the handle 14 to extend away from wall 40, to further reduce the possibility of marring or dirtying wall 40 in the process of laying carpet 32.

In operation, the user grips handle 14 in either the long configuration utilizing first and second portions 18 and 20 thereof or simply first portion 18, dependent on the tightness of the working quarters. For example, merely employing handle portion 18 would prove ideal in a small closet area where a carpet is being laid. The installer then places tack board 38 and foam pad 41 on floor 52, FIG. 3. Carpet 32 is then placed atop foam pad 41 and tack board 38 and cut to size such that edge 34 may be tucked into gap 36. Simultaneously, flange 30 pushes edge 34 of carpet 32 into gap 36, and endless surface 42 presses carpet 32 onto tack board 38. Cylindrical body 43 prevents flange 30 from jamming in gap 36. It may be apparent that cylindrical body 43 and flange 30 rotate with outer race 50 of bearing 46. Handle 14 extends outwardly from wall 40 along its axis 70 such that the installers hands do not rub against the wall 40 during the installation process. Cover 25 eventually wears out in the carpet laying process due to the non-damaging soft characteristic of the plastic material from which it is composed. At that time, the installer may remove cover 25, FIG. 6, and replace it with a like cover for further use.

While in foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A carpet tucking device; comprising:

a. a rotatable member including a core and a cover for said core forming an outer surface of said rotatable member, said cover including a first portion and a second portion, said cover first portion including a flange extending further outwardly from said core than said cover, said cover first and second portions being capable of contacting the carpet;

b. a handle; and c. a connecting element, said connecting element including a first part linked to said rotatable member, and a second part linked to said first part at an obtuse angle and further linked to said handle, said rotatable member being rotatable relative to said connecting element.

2. The carpet tucking device of claim 1 in which said core includes a bearing having an inner race and an outer race fastened to said cover.

3. The carpet tucking device of claim 2 in which said connecting element further comprises a tongue connected to said inner race of said bearing.

4. The carpet tucking device of claim 3 in which said cover is removably fastened to said outer race of said bearing of said core.

5. The carpet tucking device of claim 4 in which said cover is formed of flexible material.

6. The carpet tucking device of claim 3 in which said core further includes a pin extending from said inner race of said bearing and said cover is a hollow member, said pin extending to the interior of said cover.

7. The carpet tucking device of claim 6 in which said pin of said core connects to said tongue of said connecting element.

8. The carpet tucking device of claim 1 in which said cover second portion further includes a body having an endless surface.

9. The carpet tucking device of claim 1 in which said handle includes a first portion linked to said second part of said connecting element, and a removable second portion.

10. The carpet tucking device of claim 9 in which said handle first and second portions each include gripping members.

* * * * *